United States Patent [19]

Tepfer

[11] 3,970,129

[45] July 20, 1976

[54] SALES SLIP WALLET

[76] Inventor: Barry Tepfer, 2 Lawrence St., New Hyde Park, N.Y. 11040

[22] Filed: Mar. 19, 1975

[21] Appl. No.: 559,698

[52] U.S. Cl. ..... 150/39; 206/805
[51] Int. Cl.[2] ..... A45C 11/18
[58] Field of Search ..... 150/39, 38; 206/805

[56] References Cited

UNITED STATES PATENTS

| | | | |
|---|---|---|---|
| 308,942 | 12/1884 | Yewell | 206/805 |
| 404,260 | 5/1889 | Conant | 206/805 |
| 2,851,804 | 9/1958 | Roach | 206/805 |
| 2,930,557 | 3/1960 | Richards | 206/805 |

FOREIGN PATENTS OR APPLICATIONS

| | | | |
|---|---|---|---|
| 6,702,023 | 8/1967 | Netherlands | 206/805 |
| 15,731 | 7/1912 | United Kingdom | 206/805 |

*Primary Examiner*—Ro E. Hart
*Attorney, Agent, or Firm*—Bauer, Amer & King

[57] ABSTRACT

A low cost, easily fabricated wallet and holder particularly for credit card receipts, small pieces of paper and the like comprises a pair of opposed panels. An elastic member joins the panels and is positioned proximate the periphery thereof. The elastic member biases the panels together allowing temporary separation thereof and insertion of the papers therein. The outboard faces of the panels provide a large and conspicuous area on which various advertising indicia may be placed.

The aforementioned abstract is neither intended to define the invention of the application which, of course, is measured by the claims, nor is it intended to be limiting as to the scope of the invention in any way.

10 Claims, 7 Drawing Figures

SALES SLIP WALLET

FIELD OF THE INVENTION

This invention relates to a wallet and more particularly the present invention relates to a low cost holder for credit card receipts, small pieces of paper and the like.

BACKGROUND OF THE INVENTION

The various credit card receipts received over a period of time are easily lost or misplaced due to their relatively small size. This loss can be an irksome discovery when at a subsequent time the receipts or slips need to be produced. Also many charge account and credit card organizations have discontinued mailing of duplicate copies of purchase receipts employing instead a computer readout.

Then, too, there is a wide market for low cost advertising novelties that are given away and which carry an advertising message. Unfortunately with many of these advertising gratuities, the advertising area is small or the utility of the gratuity is marginal, or both.

SUMMARY OF THE INVENTION

It is therefore an object of the present invention to provide a low cost holder or wallet for credit card receipts, sales slips, various pieces of paper and the like.

It is another object of the present invention to provide an advertising gratuity that will find wide application by having a large and conspicuous area with which to display an advertising message.

It is a further object of the present invention to provide a low cost holder for various papers that can be fabricated of plastic, cardboard, oak tag, and the like.

Other objects and features of the present invention will become apparent from the following detailed description considered in connection with the accompanying drawings. It is to be understood however that the drawings are designed for purposes of illustration only and not as a definition of the limits of the invention for which reference should be made to the appending claims.

BRIEF DESCRIPTION OF THE DRAWING

In the drawings wherein the same reference numeral denotes the same element throughout the several views.

DESCRIPTION OF THE PREFERRED EMBODIMENTS

In general the present invention includes two flaps or panels strategically held and biased together by elastic means. The papers are deposited in the opposed or confronting sides of the panels, the temporary separation of which is provided for by stretching the elastic. The outboard face of each panel is defined by a relatively large area on which advertising indicia can be displayed.

Figure 2:
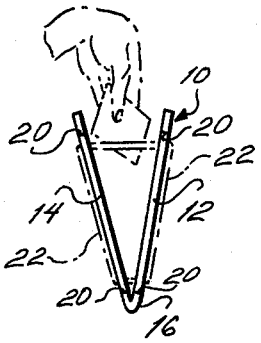
FIG. 2 is an end view of the wallet of FIG. 1 with the panels being temporarily separated and showing placement of a slip of paper therein.
Figure 1:
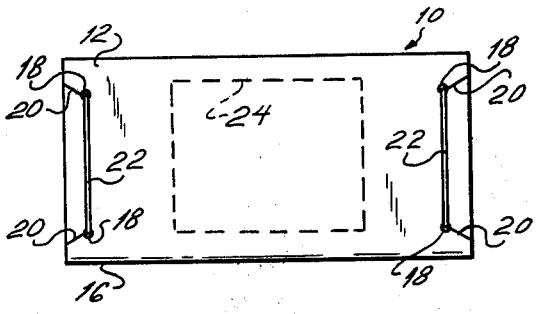
FIG. 1 is a front view of one embodiment of the wallet or holder according to the present invention.

Turning now to FIGS. 1 and 2, there is shown one embodiment of the present invention. The credit receipt wallet or holder, indicated generally by reference numeral 10, is formed of a folder, single sheet defining a first panel or side 12 and a second one thereof 14. As shown, the sheet is folded along a line or area 16 so that panels 12 and 14 are of the same size and in confronting relation. Each panel 12 and 14 includes a pair of coupling apertures 18 near the lateral ends of a respective panel as shown. Each one of apertures 18 preferably includes an access slot 20 communicating between a respective aperture and the adjacent lateral edge of an associated panel.

Coupling means preferably in the form of an elastic band 22 at each lateral end of the wallet commitantly engages apertures 20 and thereby biases the panels together. Slots 20 facilitate insertion of each band into its respective aperture array. An advertising message or decorative art design 24 can be printed on or otherwise attached to the outboard face of each panel 12 and 14 as shown.

Operation and use of the wallet shown in FIGS. 1 and 2 needs little elaboration. The wallet is separated along the unjoined longitudinal edges and the slip or paper inserted as shown. A feature of the inventive construction is that panels 12 and 14 automatically close owing to the biasing action of elastic means 22.

Figure 4:
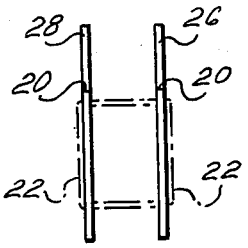
FIG. 4 is an end view of the wallet of FIG. 3 with the sides spaced for purposes of clarity and showing the connective elastics.
Figure 3:
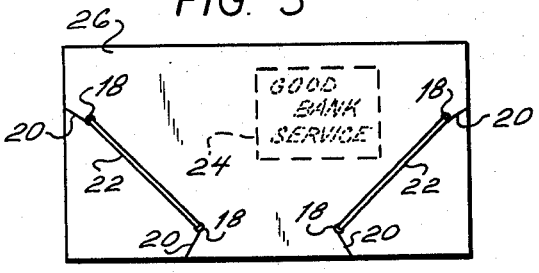
FIG. 3 is a front view of another embodiment of a wallet according to the present invention.

Referring now to FIGS. 3 and 4 there is shown another embodiment of the present invention. A pair of complimentary discrete panels 26 and 28 are substantially and preferably of rectangular configuration. Each panel 26 and 28 likewise includes a plurality of complementary coupling apertures 18. It will be noticed however that a pair of apertures straddles two of the corners as shown. Each aperture pair is canted or located caddy-corner at the corner so that, looking at FIG. 3, the upper longitudinal edge of each panel 26 and 28 is more easily opened, and accepts a larger size of paper than the lower longitudinal edge of the panels.

As was described above, slots 20 provide access to a respective one of apertures 18, and each one of a pair of elastic members 22 is disposed through the aperture array at corners shown with the elastics 22 biasing panels 26 and 28 together. Various advertising or decorative patterns 24 can be placed on the outboard face of each panel 26 and 28.

Operation of the embodiment shown in FIGS. 3 and 4 is essentially similar to that described for FIGS. 1 and 2. It will be apparent however, that, and again viewing FIG. 3, normally the papers will be inserted by separating the upper longitudinal edges of panels 26 and 28. The lower longitudinal edges will remain relatively closed to prevent any previously placed papers from falling out.

Figure 6:
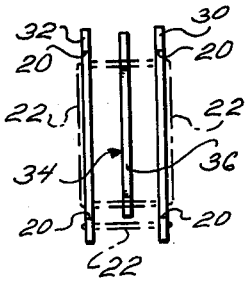
FIG. 6 is an end view of the embodiment of FIG. 5 with the sides again spaced for purposes of clarity showing placement of the divider.
Figure 5:
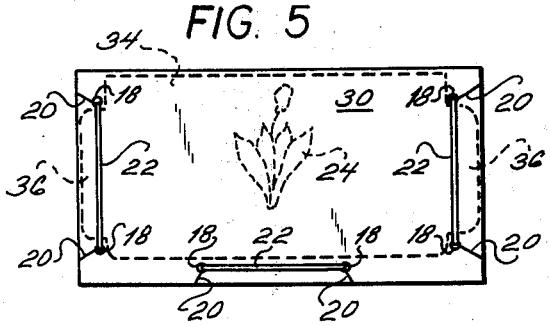
FIG. 5 is a front view of still another embodiment of the present invention having a divider.
Figure 7:
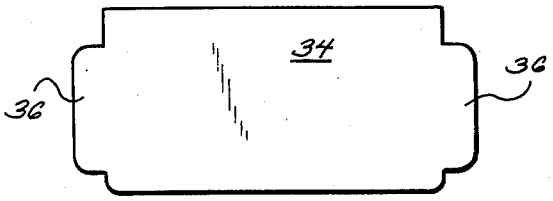
FIG. 7 is a plan view of the divider shown in FIG. 6.

In some applications, it may be desirable to provide a compartmentalized wallet so for this purpose reference is now made to FIGS. 5, 6 and 7. Two discrete panels, 30 and 32 are formed with apertures 18 substantially as shown. Hence, for each panel the three sides of the quadrilateral arrangement of sides is defined by an adjacent pair of apertures. As was noted previously, a respective one of slots 20 communicates with an associated aperture 18. Elastic means 22, which in the embodiment shown comprises three descrete elastic bands, biasingly couples each of the three corners as shown. One or more spacer or divider panels 34 of substantially complimentary configuration to panels 30 and 32 includes opposed insertion tangs 36 that comprise the lateral edges thereof. Tangs 36 of panel 34 fit between opposed bands 22 as shown. Indicia 24 may again be carried on the outboard faces of panels 30 and 32 as the case may be.

Operation of the embodiment of FIGS. 5, 6 and 7 is apparent. The receipts are inserted by separating the unjoined longitudinal edges of panels 30 and 32, that, when viewing FIG. 5, is shown as the upper longitudinal edge of the wallet.

The wallet or holder of the present invention can be fabricated from a wide variety of materials. The holder can be made from stout paper, cardboard, plastic, oak tag, leather and the like. Indeed, in some applications it may be desirable to make the inventive wallet or holder of a combination of the above materials. For example, in the embodiment shown in FIGS. 5, 6 and 7, each of the panels 30 and 32 might be comprised of transparent or colored plastic sheet and such as 0.005 inch cellulose acetate or high density polystyrene and the inside, dividing panel 34 comprised of cardboard.

Elastic means 22 is preferably a rubber band, and in the embodiments of FIGS. 1 and 3 two discrete ones thereof are used. In the embodiment of FIG. 5 three rubber bands are shown. However, in the last mentioned embodiment and in the embodiment of FIG. 3, elastic means 22 might comprise a continuous strand, serially threaded through respective aperture schemes 18.

While continuous loop elastic bands are shown in the drawing it is to be understood that a single length elastic, such as the conventional type having barbs or enlarged stops at the ends thereof may be threaded through the smaller diameter holes.

While only a few embodiments of the present invention have been shown and described, it will be apparent that many changes and modifications can be made hereto without departing from the spirit and scope hereof.

What is claimed is:

1. A low cost, easily fabricated wallet and holder particularly for credit card receipts, small pieces of paper and the like comprising panel means, and elastic means joining said panel means and positioned proximate the periphery thereof to couple the same and allow temporary separation thereof and insertion of the papers, wherein each of said panel means are formed with aperture means and slot means communicating therewith, said elastic means including a pair of elastic bands placed substantially opposed on said panel means coupling same by passing through a respective array of said aperture means access to which is provided by said slot means extending from the outer edge of said panel means to receive said elastic means.

2. The holder of claim 1 wherein said panel means includes a single sheet folded back upon itself to form two substantially equal and opposed panels.

3. The holder of claim 1 wherein said panel means comprise two panels of substantially the same size.

4. The holder of claim 3 wherein said panels are of complementary and essentially rectangular configuration, said elastic means including two rubber bands in opposed caddy-corner relation on said panels.

5. The holder of claim 3 wherein said panels are of complementary and essentially rectangular configuration, said elastic means including three rubber bands perimatically placed on said panels and disposed through said aperture means.

6. The holder of claim 5 including a divider interposed between said panels to compartmentalize the space therebetween.

7. The holder of claim 6 wherein said divider is defined by a pair of opposed tangs cooperating with an opposed pair of said rubber bands to keep said divider in the holder when the same is opened.

8. The holder of claim 1 wherein the outboard faces of said panel means include space for receiving advertising indicia.

9. The holder of claim 1 wherein said panel means are fabricated of stiff paper.

10. The holder of claim 1 wherein said panel means are fabricated of plastic sheet.

* * * * *